US007350524B2

(12) United States Patent
Kimura et al.

(10) Patent No.: US 7,350,524 B2
(45) Date of Patent: Apr. 1, 2008

(54) LIQUID-APPLYING DEVICE

(75) Inventors: Yoshinobu Kimura, Tokyo (JP); Takatoshi Saito, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/574,706

(22) PCT Filed: Apr. 26, 2005

(86) PCT No.: PCT/JP2005/007893

§ 371 (c)(1),
(2), (4) Date: May 19, 2006

(87) PCT Pub. No.: WO2005/104664

PCT Pub. Date: Nov. 10, 2005

(65) Prior Publication Data

US 2006/0283471 A1 Dec. 21, 2006

(30) Foreign Application Priority Data

Apr. 28, 2004 (JP) ..... 2004-134923
May 31, 2004 (JP) ..... 2004-161102

(51) Int. Cl.
*A45D 24/22* (2006.01)

(52) U.S. Cl. ..... 132/114; 132/112

(58) Field of Classification Search ..... 132/112–116; 401/270, 277, 186, 280, 278
See application file for complete search history.

(56) References Cited

U.S. PATENT DOCUMENTS 1,686,981 A 10/1928 Olson
3,463,170 A 8/1969 McCullough
3,915,577 A * 10/1975 Cropton ..... 401/186
3,961,635 A * 6/1976 Miya ..... 132/113
4,279,527 A * 7/1981 Moe et al. ..... 401/277
5,547,303 A * 8/1996 Pyrozyk ..... 401/270

FOREIGN PATENT DOCUMENTS

JP A 02-050226 2/1990
JP A 11-009330 1/1999
JP A 11-127943 5/1999
JP A 2001-321222 11/2001
JP A 2003-192031 7/2003

* cited by examiner

*Primary Examiner*—Robyn Doan
(74) *Attorney, Agent, or Firm*—Oliff & Berridge, PLC

(57) ABSTRACT

A liquid-applying device is provided, which does not allow the contents to touch the skin of the head when the contents are applied to the hair. The volume of liquid to be discharged from this device can be controlled. The comb attachment is small and can be dismounted. After the use, inside flow passage can be closed. Even if this device is used with a tubular container having the force of recovery, the container is prevented from taking in outside air (oxygen, etc.), and thus, is protected against dust and/or bacteria in the air.

The liquid-applying device comprises a tubular container, a connecting/discharging unit, and a comb attachment. The connecting/discharging unit has a cylindrical passage and a fitting cylinder that can be fitted to the neck of the tubular container. The comb attachment comprises a comb shaft fitted detachably to the connecting/discharging unit and a row of teeth disposed along one side of the comb shaft and extending laterally. At the front and the rear of the row, there is a pair of solid teeth, which sandwiches a row of liquid-applying teeth, each liquid-applying tooth having discharge ports opened at the tip. The solid teeth at the front and the rear are taller than the row of liquid-applying teeth.

An inside plug is fitted to the tubular container, and the connecting cylinder of the connecting/discharging unit is used to open or close the passage holes of the inside plug. In an embodiment, a valve unit is installed inside the tubular container.

3 Claims, 10 Drawing Sheets

(a)

(b)

(a)

(b)

(a)

(b)

(a)

(b)

LIQUID-APPLYING DEVICE

TECHNICAL FIELD

This invention relates to a liquid-applying device, and in particular, to a liquid-applying device having a comb attached to container neck so that contents inside the container can be applied.

BACKGROUND ART

Applicators equipped with a comb attachment have been conventionally known as hairdye-applying containers, in which the hairdye is squeezed out of the squeezable container into the interstices between teeth of the comb attachment so that the hairdye can be applied onto the hair (See Patent Document 1).

There is also a known applicator equipped with an applying unit in the shape of a hairbrush, which is attached to the neck of a tubular container (See Patent Document 2).

[Patent Document 1] patent application No. 1999-9330

[Patent Document 2] Utility model application No. 1990-50226

DISCLOSURE OF THE INVENTION

However, the comb-attached applicator of the above-described Patent Document 1 has the comb of a normal size. It is effective in applying the hairdye all over the hair or in a certain area thereof. If the hairdye is applied onto a narrow part of the hair, the comb (4) has to be taken away so that the hairdye may be directly applied from the nozzle (12).

Therefore, a problem is that a hand may be spoiled when the user removes the comb attachment. Another problem is that, because it is difficult to control the squeeze manually, a suitable amount of hairdye cannot be squeezed out when the user squeezes the container.

In the case of the prior art described in Patent Document 2, the contents are discharged by keeping the container squeezed, and are applied to the hair by means of a hairbrush. A problem in this case is that the contents may escape outside when the container is squeezed by mistake with no intention of hairdye application.

There was a problem arising from the use of a cap that covers the applicator of the brush type. If the container was mistakenly squeezed, the contents were discharged within the cap and remained there. Sometimes, the contents pushed up the cap and escaped outside.

The brush type had also a cleaning problem. Loose hair, dirt deposited on the applying device, and solidified hairdye piled up between teeth of the brush, and could not be removed easily by washing the brush with water or a cleaning solution.

If the container is made of a synthetic resin that has a certain level of restoring force, the body gradually restores to its original shape, thus resulting in a low inner pressure and causing a problem of allowing air to enter the container.

Therefore, this air-sucking problem led to another problem that the contents in a reduced amount failed to be discharged quickly at the time of a next squeeze and still another problem of degeneration of the contents caused by the air (oxygen) and/or by miscellaneous bacteria.

This invention has been made to solve the above-described problems. An object of this invention is to provide a liquid-applying device comprising a small-size comb attachment having a row of teeth and a connecting/discharging unit having said comb attachment fitted thereto, wherein a pair of solid teeth is disposed at the front and the rear of the row of teeth so as to sandwich the row of liquid-applying teeth which are shorter in height than the solid teeth, each liquid-applying tooth having a hollow discharge path inside and discharge ports at the tip, and wherein said connecting/discharging unit is rotated within a defined central angle to let the unit go up or down and open or close the passage between inside plug and this unit and to enable the flow rate to be controlled. Another object of this invention is to provide a liquid-applying device, which is attached to a synthetic resin tubular container having a mechanism for preventing intake of outside air.

The above-described problems are solved by the liquid-applying device of this invention having the configuration described below.

More specifically, the liquid-applying device comprises a tubular container, a connecting/discharging unit, and a comb attachment. The connecting/discharging unit has a passage and a fitting cylinder that can be fitted to the neck of the tubular container. The comb attachment comprises a comb shaft fitted to the connecting/discharging unit and a row of teeth disposed along one side of the comb shaft and extending laterally. At the front and the rear of the row of teeth, there is a pair of solid teeth, which sandwiches a row of liquid-applying teeth, each liquid-applying tooth having a hollow discharge path inside and having discharge ports at the tip. The solid teeth at the front and the rear are taller than the liquid-applying teeth.

The comb shaft is inclined from the central axis of the passage at an angle of 30 degrees or less.

The tubular container comprises a top flat surface having a raised portion in the center and a neck having screw thread spirally disposed on the outer wall of the neck. The raised portion has an opening into which an inside plug is fitted. The inside plug comprises a bottom plate and a peripheral wall having passage holes in the lower portion. As described above, this inside plug is fitted into the opening of the raised portion that rises from the top flat surface. The connecting/discharging unit comprises a connecting cylinder which is inserted into the inside plug so as to open or close the passage holes formed in the peripheral wall of the inside plug. A screw thread is formed on the inner wall of the fitting cylinder for the screw engagement with the screw thread of the neck.

As another embodiment of the tubular container and the connecting/discharging unit, a locking ring is formed so as to extend sideways from the upper end of the tube neck, and is engaged with the engaging ring disposed on the inner wall of the fitting cylinder of the connecting/discharging unit. This locking ring of the neck is used to set the upper limit of upward movement permitted to the fitting cylinder.

In this embodiment, a valve unit having a valve cylinder is disposed inside the neck of the tubular container. When the contents are squeezed out of the container, said valve unit serves to prevent the backward flow of the contents and the intake of outside air.

EFFECTS OF THE INVENTION

The liquid-applying device of this invention having above-described configurations has the following effects:

The row of teeth of the comb attachment comprises a pair of solid teeth at the front and the rear of the row of teeth and liquid-applying teeth sandwiched by the pair of solid teeth. Each liquid-applying tooth is shorter in height than the solid teeth and has a hollow discharge path inside and discharge ports at the tip. Under this configuration, the liquid-applying teeth sandwiched by the solid teeth are not in touch with the skin of the head when the solid teeth at the front and the rear touch the skin. Therefore, when the contents coming out of the discharge ports are applied onto the hair, the contents do not touch the skin directly.

The comb attachment can be made in a large or small size without changing the structure.

Passage holes are drilled in the wall of the inside plug, and the connecting/discharging unit has a connecting cylinder, which is used to open or close these passage holes. The connecting/discharging unit can be rotated within a defined central angle to open or close the passage between the inside plug and the comb attachment. Furthermore, the flow rate can also be controlled according to the degree to which the passage holes are opened or closed.

The comb attachment can be detached from the connecting/discharging unit for cleaning.

The container can be prevented from taking in outside air, by closing the passage holes of the inside plug. If a check valve is equipped inside the container neck, the check valve prevents the body from restoring, the inner pressure from decreasing, and outside air from entering the container, even in the case of a synthetic resin tubular container having the force of restoring to the original state. As a result, the contents are prevented from being degenerated by the oxygen in the air or being contaminated with dust or bacteria.

Figure 1:
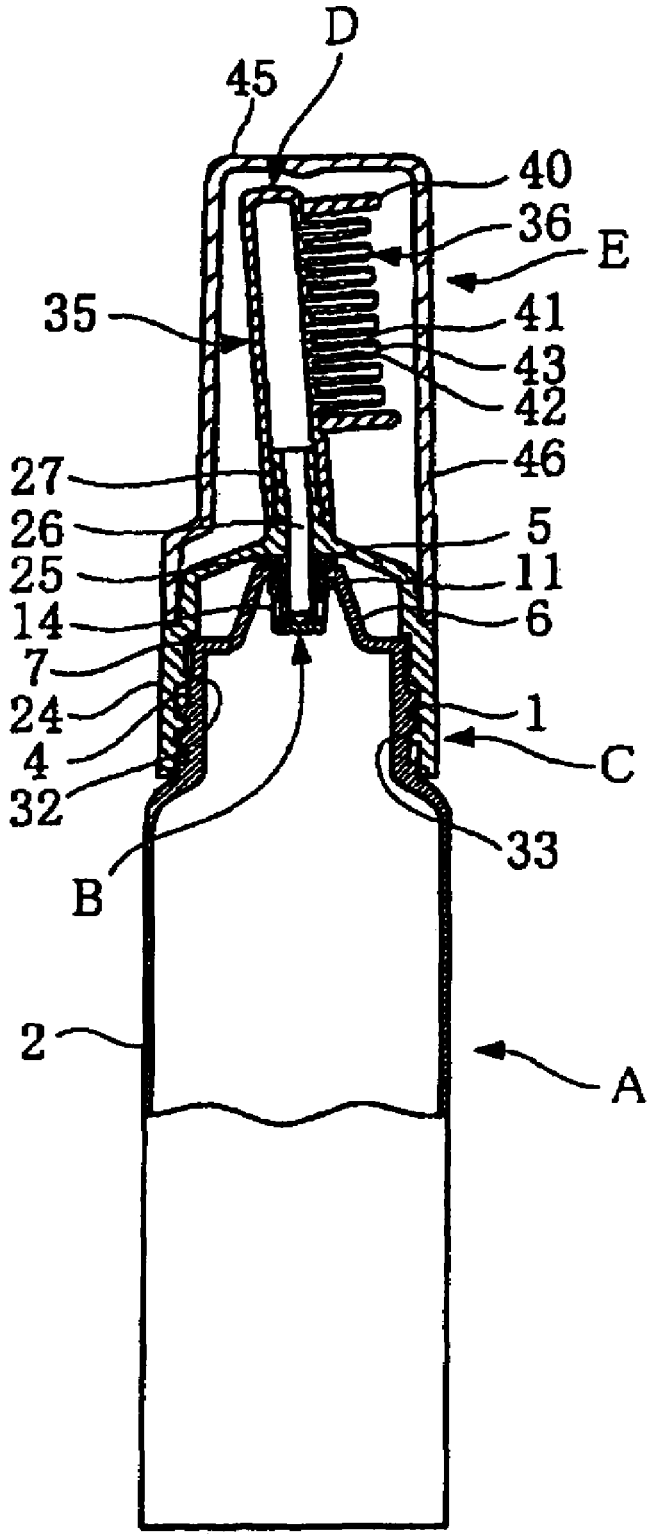
FIG. 1 is a front elevational view, with a partially vertical section, of the liquid-applying device in the first embodiment of this invention.

| Explanation of Codes | |
|---|---|
| A, Aa | Container |
| B | Inside plug |
| C | Connecting/discharging unit |
| D | Comb attachment |
| E | Cap |
| 1, 1a | Upper neck portion |
| 2, 2a | Body |
| 3, 3a | Top flat surface |

-continued

| Explanation of Codes | |
|---|---|
| 4, 4a | Neck |
| 5, 5a | Opening |
| 6, 6a | Raised portion |
| 7, 7a | Locking ring |
| 8, 8a | Narrowed portion |
| 9, 9a | Screw thread |
| 10 | Flange |
| 11 | Peripheral wall |
| 12 | Bottom plate |
| 13 | Locking ring |
| 14 | Passage hole |
| 15 | Stop ring |
| 20 | Shoulder |
| 24 | Fitting cylinder |
| 25 | Connecting cylinder |
| 26 | Passage |
| 27 | Discharge cylinder |
| 28 | Locking ridge |
| 29 | Thick wall portion |
| 30 | Narrowed wall portion |
| 31 | Screw cylinder |
| 32 | Engaging ring |
| 33 | Screw thread |
| 35 | Comb shaft |
| 36 | Row of teeth |
| 37 | Comb top surface |
| 38 | Shaft wall |
| 39 | Engaging groove |
| 40 | Solid tooth |
| 41 | Liquid-applying teeth |
| 42 | Discharge path |
| 43 | Discharge port |
| 50 | Valve unit |
| 51 | Valve cylinder |
| 52 | Valve support |
| 53 | Fitting cylinder |
| 55 | Valve |
| 56 | Valve hole |
| 57 | Top support surface |
| 58 | Upper and lower peripheral walls |
| 58a | Narrowed portion |
| 58b | Widened portion |
| 59 | Terrace |
| 60, 61 | Fitting ridge |

PREFERRED EMBODIMENTS OF THE INVENTION

This invention is further described with respect to the preferred embodiments, now referring to the drawings.

[First Embodiment]

FIG. 1 shows a liquid-applying device of this invention, in which A is the container, B is the inside plug, C is the connecting/discharging unit, D is the comb attachment which is fitted to the connecting/discharging unit, and E is the cap.

Figure 2:
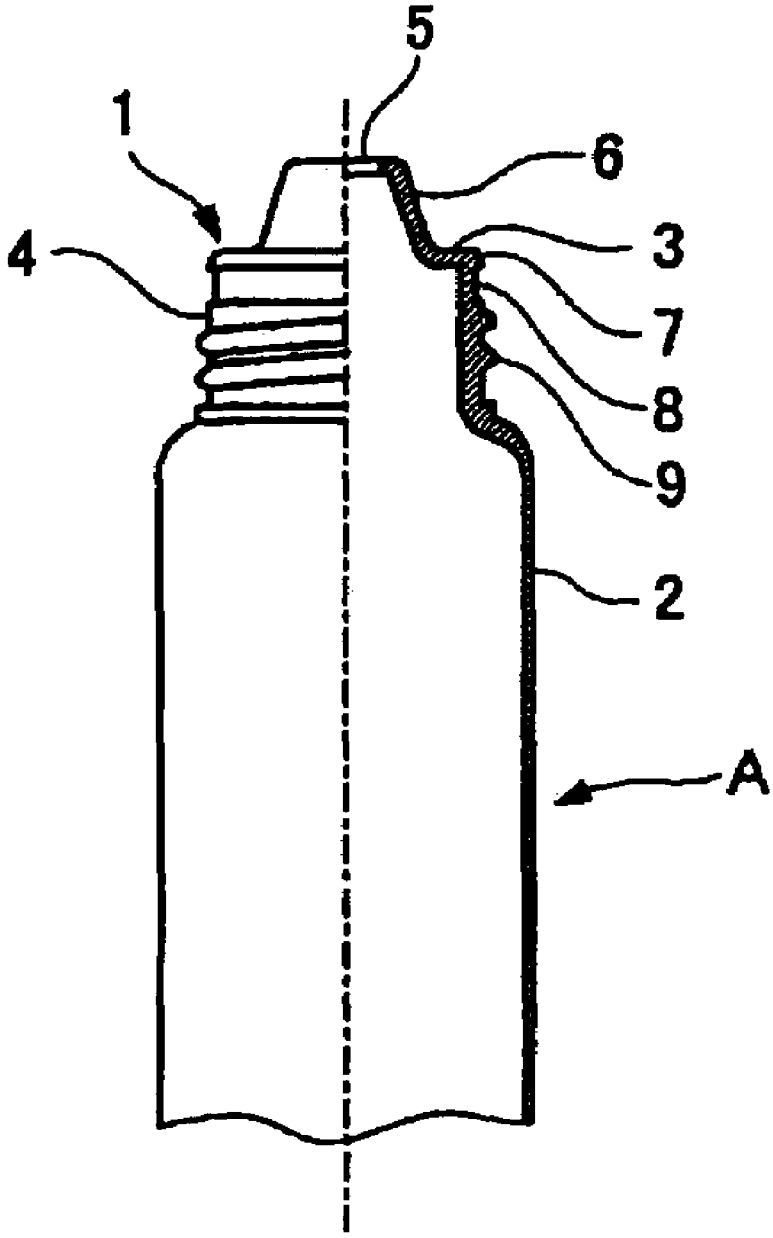
FIG. 2 is a front elevational view, with a partially vertical section, of the container neck.

The container A is a tubular container and comprises the upper neck portion 1 and the squeezable body 2. As shown in FIG. 2, the upper neck portion 1 of the container A comprises the top flat surface 3 and the neck 4.

The raised portion 6 rises from the top flat surface 3, and an opening 5 is formed in the center of the raised portion 6.

At the top edge of the neck 4 is a locking ring 7 which is projected laterally. Under the locking ring 7 are a narrowed portion 8 and a screwed wall having a screw thread 9.

Figure 3:
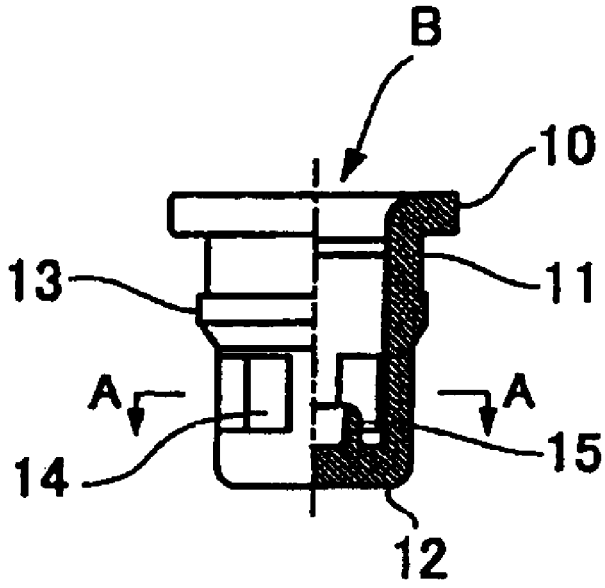
FIG. 3 includes explanatory diagrams of the inside plug, in which (a) is a front elevational view, with the right side being a vertical section, and (b) is a cross-sectional view, taken from line A-A of FIG. 3(*a*).
Figure 3:
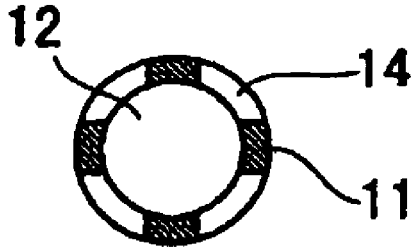

FIG. 3 shows the inside plug B. As shown, the inside plug B is provided with a flange 10 at the top edge, a peripheral side wall 11 under this flange 10, and a bottom plate 12. Below the flange 10 is a locking ridge 13 which is engaged with the lower edge of the opening 5. Under the locking ridge 13 is a number of passage holes 14 equally spaced with one another, as shown in FIG. 3(*b*).

The bottom plate 12 has a stop ring 15, which is disposed inside the peripheral wall 11.

Figure 4:
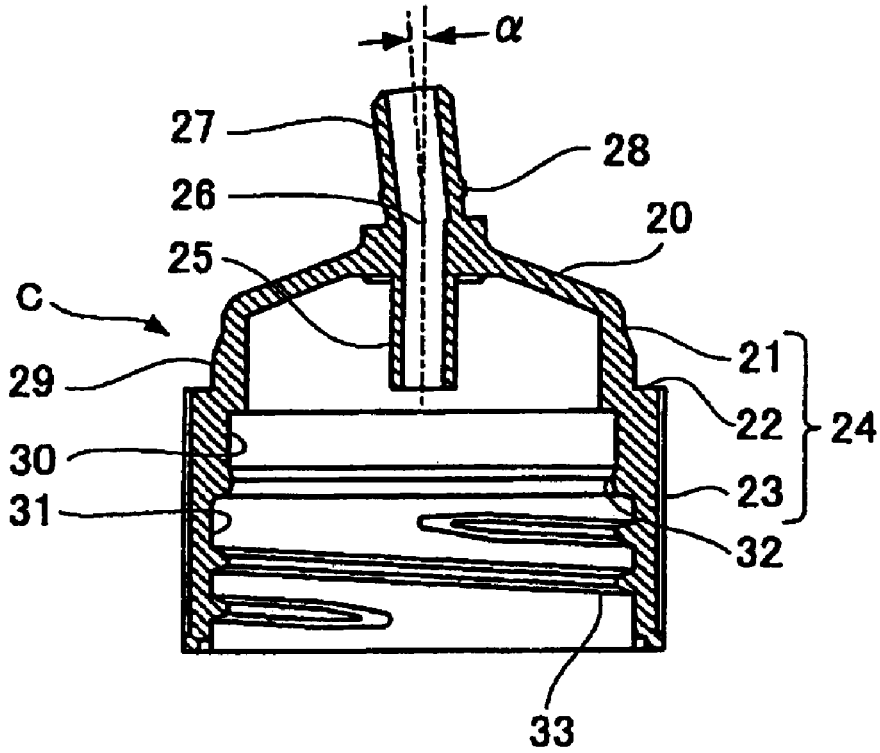
FIG. 4 is a front elevational vertical section of the connecting/discharging unit.

FIG. 4 shows the connecting/discharging unit C. As shown in FIG. 4, the connecting/discharging unit C is provided with a fitting cylinder 24 which comprises an upper peripheral wall 21 and a lower peripheral wall 23, with the terrace 22 in between. Shoulder 20 is disposed directly on the upper peripheral wall 21, and a passage 26 is open at the center of this shoulder 20.

A connecting cylinder 25 extends downward from under the shoulder 20 and also connects to the passage 26. On the other hand, a discharge cylinder 27 extends upward from the surface of the shoulder 20. This discharge cylinder 27 connects to the passage 26, and extends upward at an angle, $\alpha$, of 30 degrees or below from the central axis of the passage 26. A projected locking ridge 28 is peripherally disposed in the lower portion of the outer wall of the discharge cylinder 27.

A thick wall portion 29 is formed around the lower end of upper peripheral wall 21.

The inner wall of lower peripheral wall 23 is provided with a narrowed wall portion 30 in the upper area and a screw cylinder 31 in the lower area. An engaging ring 32 is disposed at the lower end of the narrowed wall portion 30 and is engaged with the locking ring 7 of the neck 4 when fitting cylinder 24 is screwed upward from the container A. The inner wall of the screw cylinder 31 is provided with a screw thread 33.

Figure 5:
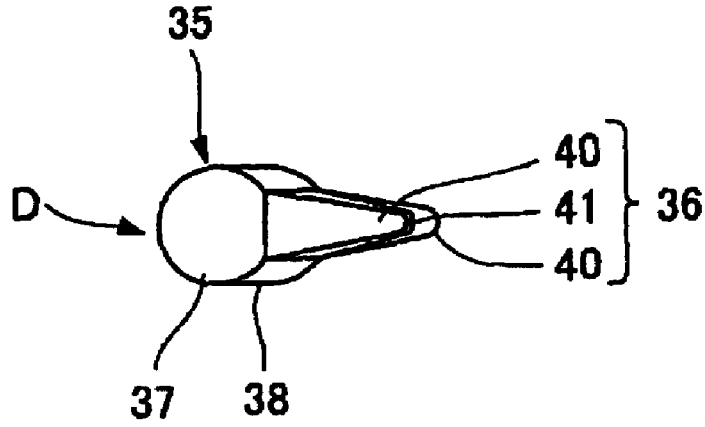
FIG. 5 includes explanatory diagrams of the comb attachment, in which (a) is a top view, and (b) is a vertical section.
Figure 5:
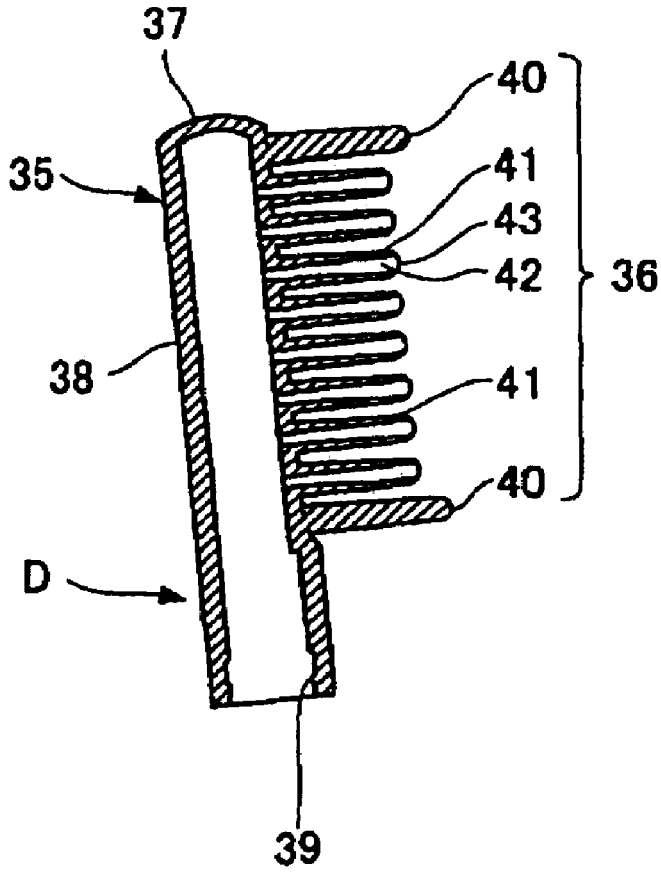

FIGS. 5(*a*) and 5(*b*) show the comb attachment D comprising a comb shaft 35 in a round rod shape and a row of teeth 36 extending laterally along one side of the shaft 35.

The comb shaft 35 is provided with a comb top 37 and a shaft wall 38. The teeth extend along one side of the shaft wall 38 at regular intervals. The lower end of the shaft wall 38 is formed in a manner capable of inserting therein the discharge cylinder 27 of the connecting/discharging unit C. An engaging groove 39 is disposed in the lower portion of the shaft wall 38 inside and is engaged with the locking ridge 28 of the discharge cylinder 27.

The row of teeth 36 comprises a pair of solid teeth 40 at the front and the rear of the row and the equally spaced liquid-applying teeth 41 sandwiched between the front and the rear solid teeth 40. Each liquid-applying tooth 41 has a discharge path 42 inside and discharge ports 43 at the tip. The discharge ports 43 are connected to the inside of the comb shaft 35 through the discharge path 42. The liquid-applying teeth 41 are shorter in height than the solid teeth 40.

Figure 6:
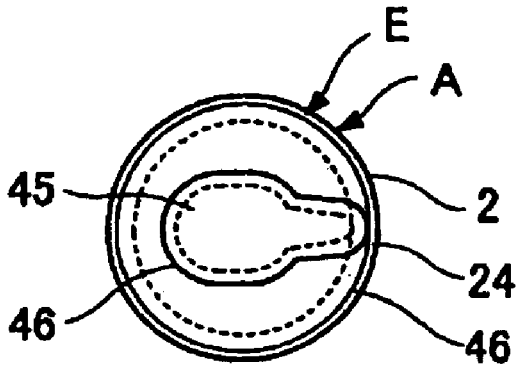
FIG. 6 includes explanatory diagrams of the liquid-applying device having a cap fitted, in which (a) is a top view and (b) is a vertical section.
Figure 6:
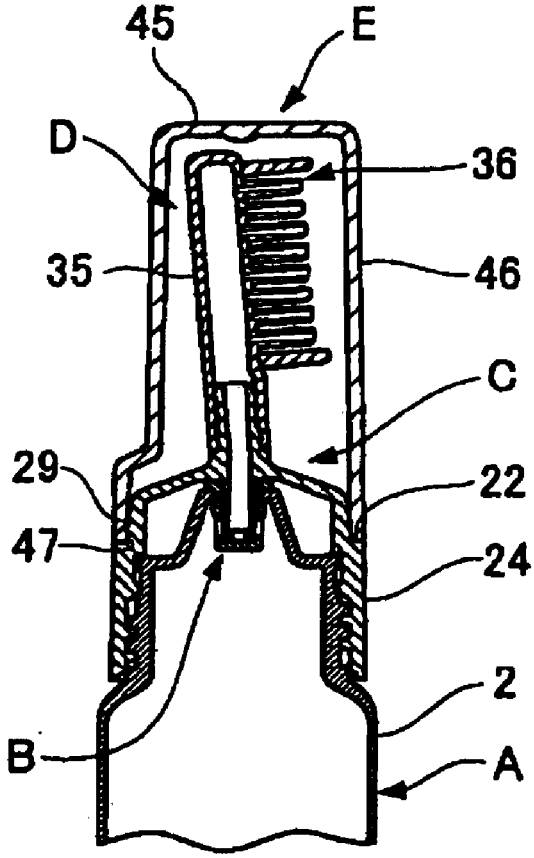

FIGS. 6(*a*) and 6(*b*) show the cap E comprising a cap top surface 45 in a shape roughly similar to the cross-sectional shape of the comb attachment D and also a cap peripheral wall 46.

The upper portion of the cap E comprises the cap peripheral wall 46, which hangs from the cap top surface 45 and has a contour similar to the shape of the comb attachment D. It is preferred to cover the comb attachment D with the cap E in such a way that the inside space can be as small as possible between the cap top surface 45 and the cap peripheral wall 46 on one hand and the comb shaft 35 and the row of teeth 36 on the other hand.

The lower portion of the cap E comprises the cap peripheral wall 46 in a cylindrical shape. An engaging ridge 47 is disposed near the lower end of the cap peripheral wall 46, and is engaged with the thick wall portion 29 when the cap peripheral wall 46 butts against the terrace 22 of the connecting/discharging unit C.

The procedure for assembling the liquid-applying device will be described below.

Figure 7:
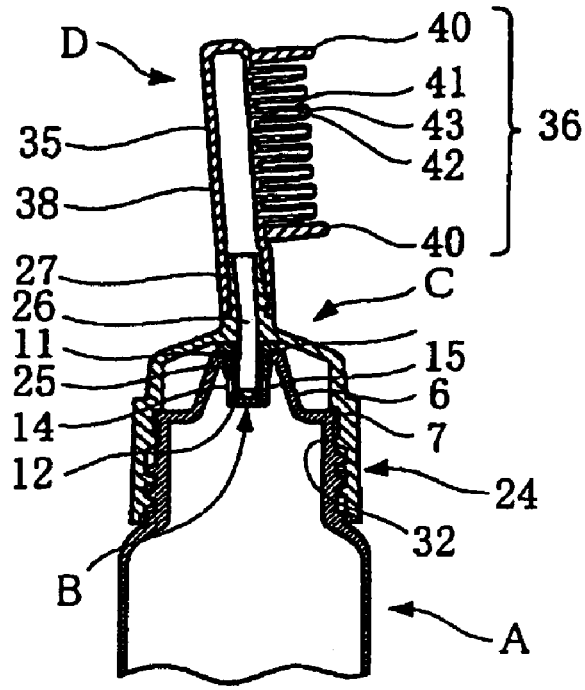
FIG. 7 includes explanatory diagrams showing the relationship between the inside plug and the connecting/discharging unit, in which (a) shows a vertical section of the device before use and (b) shows that of the device in use.
Figure 7:
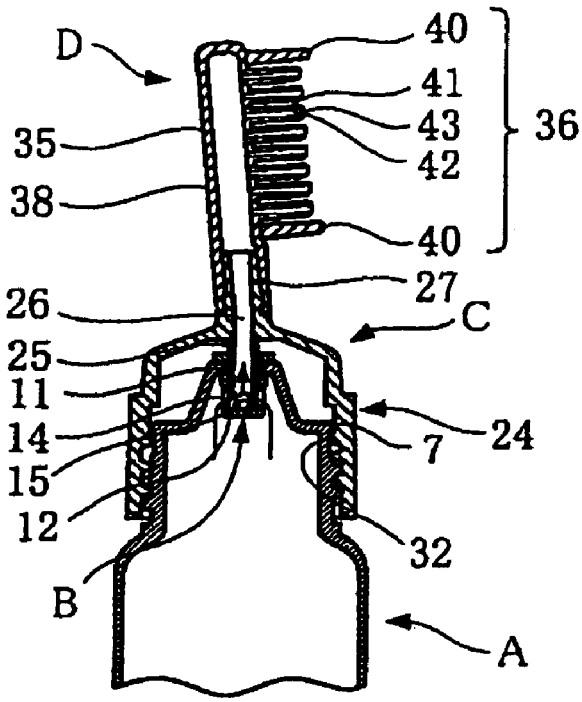

The inside plug B is inserted, first from the bottom plate 12, into the opening 5 of the top flat surface 3 of the container A. As shown in FIG. 7(*a*), the inside plug B is fitted to the container A by setting the inside plug B in the opening 5 with the help of the flange 10 and the locking ring 13.

The connecting/discharging unit C is fitted to the container A by turning the fitting cylinder 24 and screwing it on the neck 4. As the fitting cylinder 24 goes down, the engaging ring 32 is engaged with the locking ring 7, and clicks in place. If the fitting cylinder 24 is further made to turn, then the engaging ring 32 climbs over the locking ring 7, and the fitting cylinder 24 keeps going down until it reaches the lowest position.

In that state, the lower end of the connecting cylinder 25 of the passage 26 comes in contact with the bottom plate 12 of the inside plug B. And the outer wall of the connecting cylinder 25 closes the passage holes 14, and the stop ring 15 of the bottom plate 12 is fitted in the connecting cylinder 25. As a result, the flow path to the passage 26 is blocked.

The comb attachment D is fitted to the connecting/discharging unit C by fitting the comb shaft 35 around the discharge cylinder 27 of the connecting/discharging unit C so that the inside of the shaft wall 38 comes in contact with the outer wall of the discharge cylinder 27. The engaging groove 39 of the shaft wall 38 is engaged with the locking ridge 28 of the discharge cylinder 27, and thus the comb attachment D is fixed to the connecting/discharging unit C.

The contents passing through the passage 26 of the connecting/discharging unit C are sent to the inside of the comb shaft 35 of the comb attachment D, are then channeled into respective discharge paths 42 of the liquid-applying teeth 41, and are brought to the discharge ports 43.

The liquid-applying device is further described below with respect to its mode of use and its action and effect.

In using the liquid-applying device, the user starts with removing the cap E shown in FIG. 6(*b*) from the connecting/discharging unit C. Then, the row of teeth 36 of the comb attachment D is exposed, as shown in FIG. 7(*a*).

When the fitting cylinder 24 is turned to allow the connecting/discharging unit C to go up, the engaging ring 32 on the inner wall of the lower peripheral wall 23 of the fitting cylinder 24 is engaged with the locking ring 7 that projects laterally from the upper neck portion 1. As a result, the ascent is stopped with a click, as shown in FIG. 7(*b*).

Since, at that time, the connecting cylinder 25 goes up, the passage holes 14 in the peripheral wall 11 of the inside plug B are opened, and the inside of the container A is connected to the passage 26. When the body 2 is squeezed in this state, the contents can be discharged from the discharge ports 43 of the row of teeth 36.

The width of the passage holes 14 of the inside plug B can be adjusted through the connecting cylinder 25 of the connecting/discharging unit C, by turning the fitting cylinder 24 and allowing the fitting cylinder 24 to move vertically relative to the upper neck portion 1. The flow rate of the contents can be controlled by adjusting this width.

The user can put the row of teeth 36 of the comb attachment D on a desired area of the head and combs the hair. Thus, the contents can be applied to the desired area.

At that time, the solid teeth 40 disposed at the front and the rear of the row of teeth 36 maintain constant touch with the skin, but the liquid-applying teeth 41 do not, because the liquid-applying teeth 41 are shorter in height than the solid teeth 40. The contents coming out of the discharge ports 43 of the liquid-applying teeth 41 are held in the space between the tips of the solid teeth 40 and the tips of the liquid-applying teeth 41. Therefore, the contents are applied to the hair, but do not come in direct contact with the skin.

When the application of the contents has been completed, the fitting cylinder 24 is turned in the other direction to allow the connecting/discharging unit C to go down. As shown in FIG. 7(*a*), the passage holes 14 of the inside plug B are closed. In this state, none of the contents are discharged even if the container body 2 is squeezed by mistake.

In the state in which the cap E has been fitted to the connecting/discharging unit C, the lower end of the cap E butts against the terrace 22 of the fitting cylinder 24 of the connecting/discharging unit C. Since at that time, the engaging ridge 47 is engaged with the thick wall portion 29 of the fitting cylinder 24, the space inside the cap E is kept air-tight. In addition, the air inside the cap E is in a small amount, and the air inside the liquid-applying teeth 41 is negligible. Thus, the cap E can prevent the contents from solidifying and the teeth from being clogged by dust or bacteria.

As soon as application is finished, the fitting cylinder 24 is made to go down, and the cap E is fitted to the connecting/discharging unit C. Even if a highly restorable resin is used for the tubular container, the intake of air into the container A can be minimized.

If the comb attachment D has become tainted, it can be pulled upward. The engaging groove 39 inside the shaft wall 38 is released from the engagement with the locking ridge 28 of the discharge cylinder 27, and the comb attachment D can be dismounted from the connecting/discharging unit C.

The dismounted comb attachment D can be washed with water or dipped in a cleaning fluid to get rid of dirt, dust, or unnecessary liquid deposited around the row of teeth 36.

Furthermore, the comb attachment D is dismounted from the connecting/discharging unit C, and the contents can be directly poured from the passage 26 of the connecting/discharging unit C onto a saucer or on the palm of a hand.

When the fitting cylinder 24 is turned to allow the connecting/discharging unit C to go up, the engaging ring 32 on the inner wall of the lower peripheral wall 23 of the fitting cylinder 24 is engaged with the locking ring 7 that projects laterally from the upper neck portion 1. The ascent is stopped with a click. If the fitting cylinder 24 is further turned, then the engaging ring 32 climbs over the locking ring 7. In this way, the fitting cylinder 24 is released from the screw engagement with the upper neck portion 1, and the connecting/discharging unit C can be removed from the container A.

Therefore, if the contents in the container A have been completely discharged, the user can remove the connecting/discharging unit C from the container A, fit the connecting/discharging unit C to a new container A having an inside plug B, and utilize such a container as the liquid-applying container.

[Second Embodiment]

This invention is further described with respect to another embodiment in which a mechanism for preventing the back-flow of contents is disposed in the upper neck portion of the container.

Since the configuration comprising the inside plug, the connecting/discharging unit, and the cap is the same as in the above-described first embodiment, the same codes are used for these components to simplify the description. The differences between the first and second embodiments will be described below.

Figure 8:
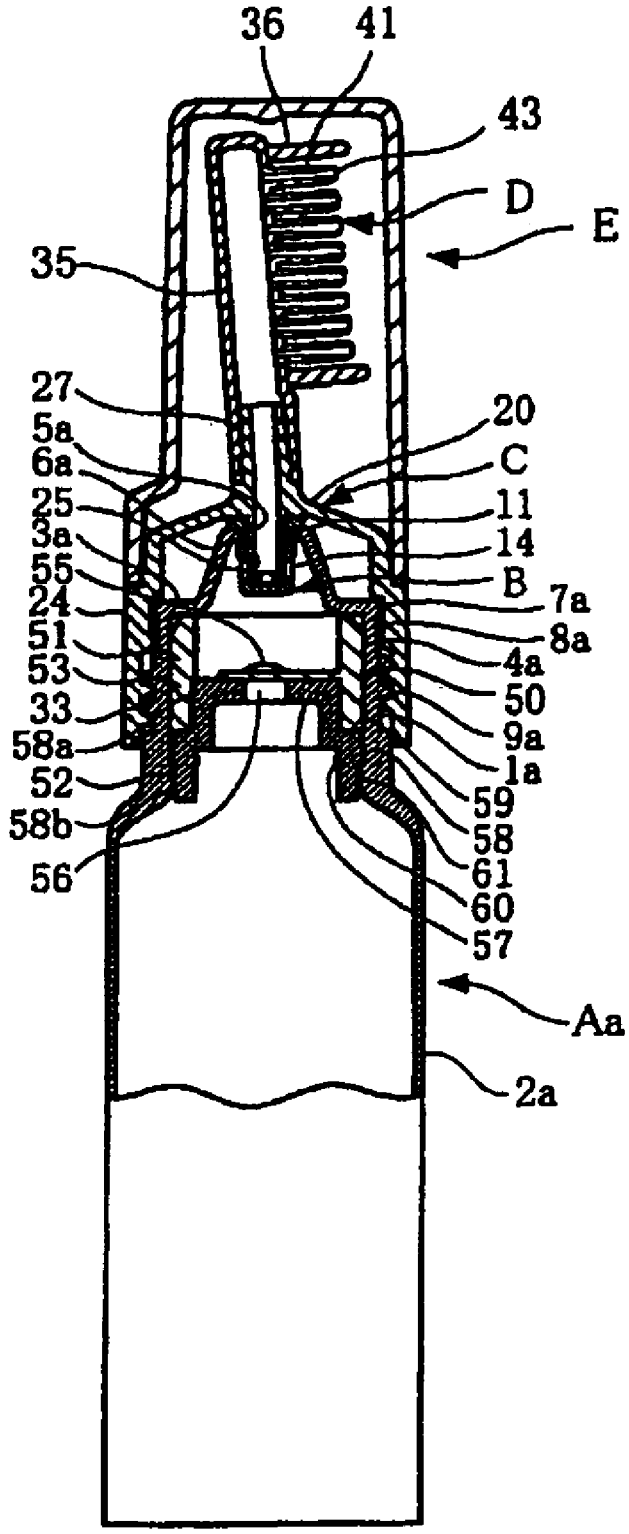
FIG. 8 is a vertical section of the liquid-applying device in the second embodiment of this invention.
Figure 9:
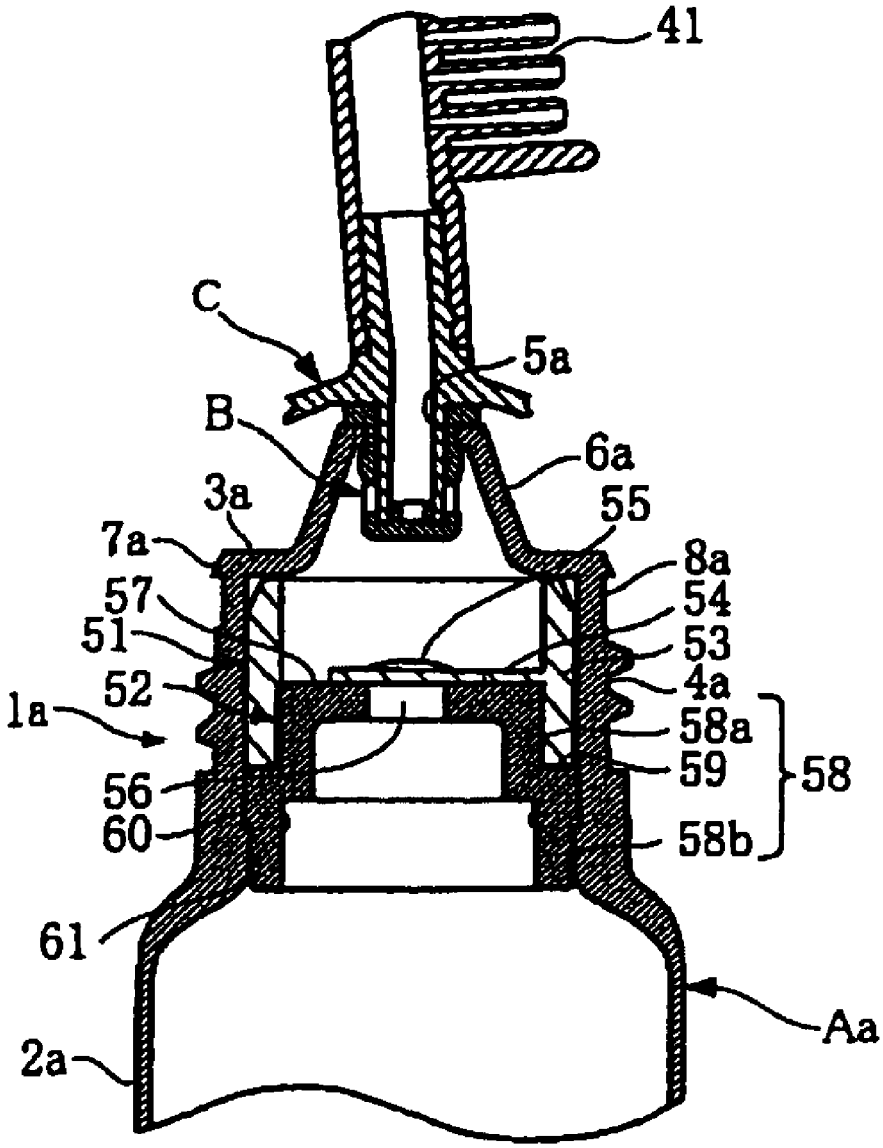
FIG. 9 is an enlarged explanatory diagram showing the valve unit.

In FIGS. 8 and 9, the liquid-applying device comprises a container Aa, the inside plug B, the connecting/discharging unit C, the comb attachment D, and the cap E.

The container Aa is a synthetic resin tubular container having a certain recovering force, and comprises an upper neck portion 1*a* and a squeezable body 2*a*.

The upper neck portion 1*a* of the container Aa comprises top flat surface 3*a* and neck 4*a*. A raised portion 6*a* is raised from top flat surface 3*a*, and an opening 5*a* is formed in the center of the raised portion 6*a*.

At the top edge of the neck 4*a* is a locking ring 7*a* which is projected laterally. Under the locking ring 7*a* are a narrowed portion 8*a* and a screwed wall having a screw thread 9*a*.

A valve unit 50, mounted inside the neck 4*a*, comprises a valve cylinder 51 and a valve support 52.

The valve cylinder 51 is provided with a fitting cylinder 53 to be fitted to the inner wall of the neck 4*a* and is provided with a valve 55. This valve 55 is located in the center of the fitting cylinder 53 and is connected thereto through one or plural connecting pieces 54.

The valve support 52 comprises a top support surface 57 and a peripheral wall 58 integrated with the top support surface 57. The top support surface 57 has a valve hole 56 in the center, and the peripheral wall 58 has a narrowed portion 58*a* in the upper area and a widened portion 58*b* in the lower area.

The narrowed portion 58*a* is fitted to the lower portion of the fitting cylinder 53 to receive the lower end of the fitting cylinder 53 onto terrace 59.

The outer wall of the widened portion 58*b* is fitted to the inner wall of the neck 4*a* of the container Aa. A fitting ridge 60 is disposed on the outer wall of this widened portion 58*b* at a middle height.

The fitting ridge 61 is located below the fitting ridge 60 at the lower end, and on the inner wall, of the neck 4*a*, and is engaged with the widened portion 58*b*.

The valve unit 50 is inserted through the bottom opening of the body 2*a* before the container Aa is filled with the contents, and is fixed inside the neck 4*a* by engaging the fitting ridge 60 of the valve support 52 with the fitting ridge 61 of the neck 4*a*.

The inside plug B having passage holes 14 drilled in the peripheral wall 11 is fitted into the raised portion 6*a* in the center of the top flat surface 3 of the container Aa in the same manner as in the first embodiment. The connecting/discharging unit C having the fitting cylinder 24 is fitted around the neck 4*a* in a manner rotatable for vertical movement.

As described above, the fitting cylinder 24 is located under the shoulder 20 and has a lower peripheral wall 23. The connecting cylinder 25 extends downward from under the shoulder 20 where the passage holes 14 of the inside plug B are opened or closed. Screw thread 33 is spirally disposed on the inner side of the lower peripheral wall 23 and is engaged with the screw thread 9*a* on the outer wall of the neck 4*a*.

In the same way as in the first embodiment, the comb shaft 35 of the comb attachment D having the row of teeth 36 is fitted around the discharge cylinder 27 of the connecting/discharging unit C. Under this configuration, the contents inside the container Aa are passed through the inside plug B and the passage of the connecting/discharging unit C, and are discharged from the discharge ports 43 of the liquid-applying teeth 41.

The liquid-applying device in the second embodiment is further describe in its action and effect.

In using the liquid-applying device, the user starts with removing the cap E, as is the case with the first embodiment. When the connecting/discharging unit C is moved up, the passage holes 14 of the inside plug B are opened.

Figure 10:
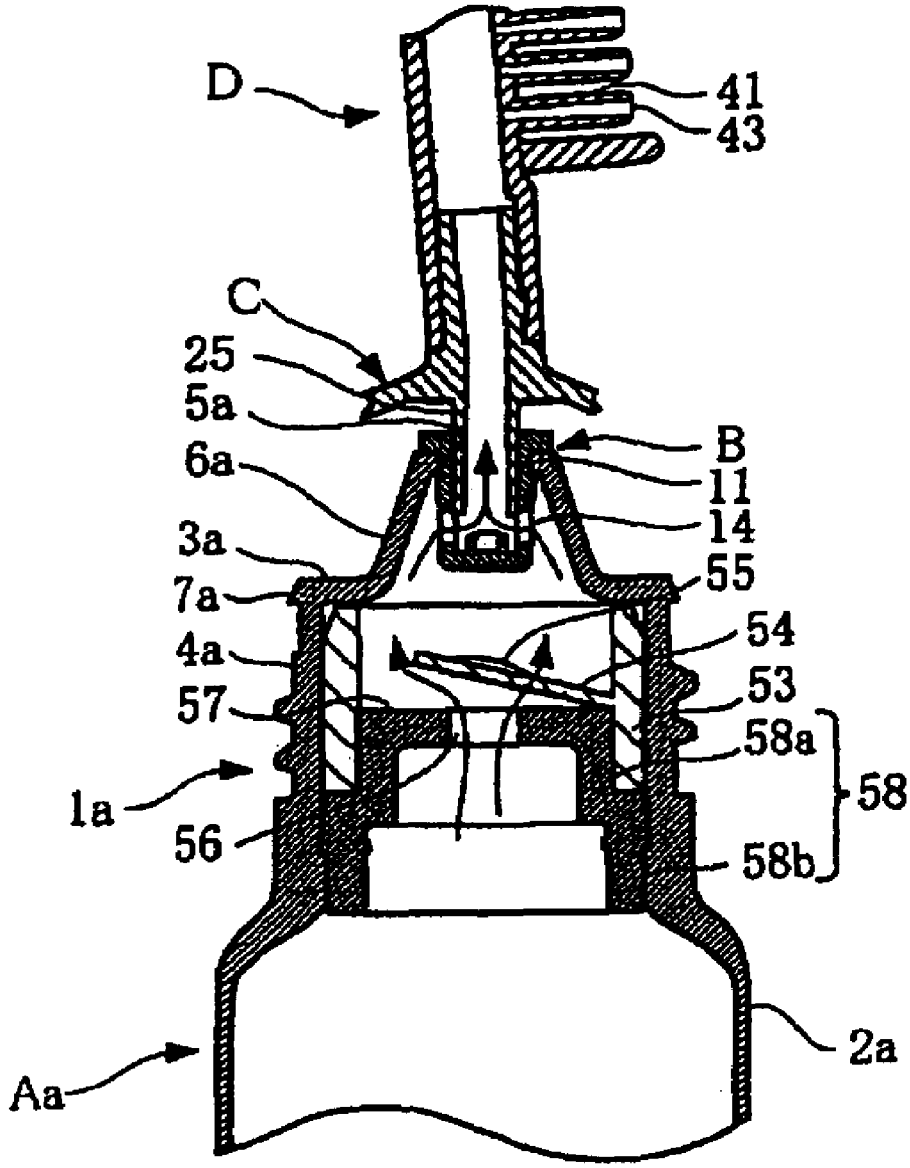
FIG. 10 is an explanatory diagram of the valve unit at the time of discharge.

Then, when the body 2*a* is squeezed, the inner pressure pushes up the valve 55 so as to open the valve hole 56, as shown in FIG. 10. The contents are passed through the valve hole 56, and enter the upper portion of the neck 4*a*. The contents are then sent to the passage holes 14 of the inside plug B, passed through the connecting/discharging unit C, enter the inside of the comb shaft 35 of the comb attachment D, and are discharged from the discharge ports 43 of the liquid-applying teeth 41.

When the squeeze of the body 2*a* is stopped, the body 2*a* restores to its original shape, because the container Aa is made of a synthetic resin having the force of recovery. As a result, the inner pressure drops, and the valve hole 56 is closed by the valve 55. Therefore, once the valve hole 56 has been closed, the recovery of the body 2*a* is inhibited with no possibility that the contents in the upper portion of the neck 4*a* is brought back into the body 2*a* or that outside air is taken in through the discharge ports 43 of the liquid-applying teeth 41.

Consequently, dust or bacteria in the air never enter the discharge ports 43. The teeth are prevented from clogging, and the contents are protected against degeneration.

If the device is used in the bath room, the valve unit prevents water from entering the container Aa.

As described above, the second embodiment shows special action and effect, in addition to the identical action and effect produced by the first embodiment.

The valve unit is not limited to the shape of the above-described embodiment. As long as the valve unit shows a similar effect, a valve unit in any shape, such as a slit valve, can be utilized.

INDUSTRIAL APPLICABILITY

The liquid-applying device of this invention can be used for partially applying the contents, such as hair manicure, to the hair. It can be utilized also as a device for applying hair dyes, decolorants such as bleach, and hair dressings.

Since the liquid-applying device of a small size can be made from a structural point of view, it can be used for brows and eyelashes as well.

The invention claimed is:

1. A liquid-applying device comprising a tubular container, a connecting/discharging unit, and a comb attachment, said tubular container comprising a top flat surface provided with a raised portion, a neck having a screw thread spirally disposed on an outer wall, and an opening in the center of said raised portion in which to fit an inside plug;

said inside plug comprising a peripheral wall having a plurality of passage holes and a bottom plate disposed under said peripheral wall, and being fitted in the opening of said raised portion;

said connecting/disposing unit comprising a discharging cylinder, a connecting cylinder which is inserted into a space surrounded by the peripheral wall of the inside plug so as to open or close the plurality of passage holes formed in the peripheral wall of the inside plug, and a fitting cylinder having a screw thread spirally disposed on an inner wall for screw engagement with the screw thread of the neck;

said comb attachment comprising a comb shaft fitted to the connecting/discharging unit and a row of teeth disposed along one side of said comb shaft and extending laterally; and said row of teeth comprising a pair of solid teeth at front and rear position of the row and liquid-discharging teeth sandwiched between said solid teeth, each liquid-discharging tooth having a hollow discharge path inside, which connects to a tunnel of the comb shaft, and having discharge ports opened at the tip, wherein said solid teeth are taller than the liquid-applying teeth.

2. The liquid-applying device according to claim 1 wherein a locking ring is formed so as to project sideways from the upper end of a tubular container neck, and is engaged with an engaging ring disposed on an inner wall of the fitting cylinder of the connecting/discharging unit, with said locking ring of the neck being used to set an upper limit to upward movement permitted to the fitting cylinder.

3. The liquid-applying device according to claim 2 wherein a valve unit having a valve cylinder is disposed inside the neck of the tubular container and is used to prevent the backward flow of contents and the intake of outside air after the contents have been squeezed out of the container.

* * * * *